US006206389B1

(12) United States Patent
Yagi

(10) Patent No.: US 6,206,389 B1
(45) Date of Patent: Mar. 27, 2001

(54) METHOD AND APPARATUS FOR SURFABLE SKATEBOARDS

(75) Inventor: George Yagi, 3705 Ignacio Cir., Stockton, CA (US) 95209

(73) Assignee: George Yagi, Stockton, CA (US)

( * ) Notice: Subject to any disclaimer, the term of this patent is extended or adjusted under 35 U.S.C. 154(b) by 0 days.

(21) Appl. No.: 09/316,980

(22) Filed: May 24, 1999

(51) Int. Cl.[7] ..... B62M 1/00
(52) U.S. Cl. ..... 280/87.042
(58) Field of Search ..... 280/87.01, 87.021, 280/87.041, 87.042, 87.043, 87.05, 7.12, 7.1, 11.22, 11.23, 11.19, 11.2, 11.27; 16/29, 30

(56) References Cited

U.S. PATENT DOCUMENTS 2,484,494 * 1/1949 Ferguson ..... 280/87.01
3,310,319 * 3/1967 Collins ..... 280/87.042
3,399,904 * 9/1968 Schinke ..... 280/87.041
3,404,425 * 10/1968 Wilder ..... 16/30
3,905,054 * 9/1975 Windsor et al. ..... 280/87.021 X
4,040,639 * 8/1977 Scardezan ..... 280/87.041
4,199,165 * 4/1980 Spitzke ..... 280/11.2
4,886,298 * 12/1989 Shols ..... 280/87.042 X
5,947,495 * 9/1999 Null et al. ..... 280/87.042
5,984,328 * 11/1999 Tipton ..... 280/87.042
5,992,865 * 11/1999 Vargas ..... 280/87.042

* cited by examiner

*Primary Examiner*—Brian L. Johnson
*Assistant Examiner*—Bryan Fischmann
(74) *Attorney, Agent, or Firm*—Peninsula Law Group; Daniel Hopen

(57) ABSTRACT

An apparatus for a surfable skateboard result in a skateboard that mimics surfing-like sensations and affords more maneuverability for the rider. The surfable skateboard comprises a deck having a tail end and a nose end, a pair of front wheel assemblies each mounted to an underside of the deck near the nose end, and a pair of rear caster assemblies each having limited swivel configured to swivelly mount to the underside of the deck near the tail end.

6 Claims, 2 Drawing Sheets

METHOD AND APPARATUS FOR SURFABLE SKATEBOARDS

BACKGROUND OF THE INVENTION

1. Field of the Invention

The present invention relates to skateboards and more particularly to skateboards having snowboard-like maneuverability.

2. Description of the Related Arts

A truly remarkable sport has evolved through the years in the form of the modern day skateboard. It is an outgrowth of earlier scooter designs employing a single roller skate divided into fore and aft parts secured to a horizontal board with the vertical T shaped handle at the front. The evolution including the elimination of the T shaped handle and the use of more sophisticated truck assemblies has produced an athletic device which allow young children and adults to develop amazing skills in the ability to travel along a straight course at high rates of speed, to perform maneuvers including hand stands, 360 degree turns, and to compete in slalom course races and many other endeavors.

In recent times, adolescents have rekindled the sport of skateboards. Sanctioned competitions with valuable prizes and awards have made skateboarding a professional sport and have aided the resurgence of interest in skateboards. However, skateboards and their basic designs have remained relatively unchanged through the changing times.

A recent craze that has captured the hearts of adolescents has been the sport of snow boarding. With snow boarding, the learning curve is less demanding than skiing. A new snow boarder typically learns to surf down the mountain in just a couple of lessons. Snowboarding is also gaining popularity because snow boarders enjoy a sense of freedom unmatched by skiing. Snow boarders are essentially surfers surfing on snow. One drawback with snowboarding is that snowboarding requires a ski area with mountains and snow. Thus, it is limited to winter season. Moreover, traveling to a ski area is expensive and can consume a lot of travel time often requiring someone with a driver's license and vehicle.

Therefore, it is desirable to provide a surfable skateboard that mimics the sensations of snowboarding and overcomes the drawbacks and limitations of snowboarding.

SUMMARY OF THE INVENTION

The present invention provides a surfable skateboard that enables the user to experience the sensation of surfing and to perform maneuvers which cannot be presently achieved with current skateboard designs. The surfable skateboard is based on mounting caster wheel assemblies on the rear wheels of a skateboard that allow the rear wheels to swivel. Thus, according to one aspect of the invention, a surfable skateboard comprises a deck having a tail end and a nose end, a pair of front wheel assemblies each mounted to an underside of the deck near the nose end, and a pair of rear caster assemblies each having limited swivel configured to swivelly mount to the underside of the deck near the tail end.

According to another aspect of the invention, the surfable skateboard includes a first channel assembly pivotly attached to the underside of the deck near the nose end wherein the pair of front wheels assemblies mounts to the first channel assembly, and a second channel assembly pivotly attached to the underside of the deck near the tail end wherein the pair of rear caster assemblies swivelly mounts to the second channel assembly. A first U-section mounted to the underside of the deck near the nose end is configured to pivotly attach the first channel assembly. A second U-section mounted to the underside of the deck near the tail end is configured to pivotly attach to the second channel assembly. The pivotly attached first channel assembly and the second channel assembly affords a rider of the surfable skateboard the ability to lean into a turn making the surfable skateboard more stable through the turn. Furthermore, the leaning effect of the surfable skateboard gives the user a carving sensation similar to those experienced while snowboarding.

According to another aspect of the invention, the surfable skateboard includes at least two lean pads attached to an upper surface of the first channel assembly and the second channel assembly configured to pivotly regulate movement of the first channel assembly and the second channel assembly. The lean pads limit the amount of lean that the deck of the surfable skateboard can pivot.

According to yet another aspect of the invention, each rear caster assembly includes a protruding limiting tang, and the second channel assembly includes cutout slots configured to receive the protruding limiting tangs for limiting swivel movement of each rear caster assembly. In the present invention, the limiting swivel movement includes forty-five degrees in either direction. Limiting the swivel movement enables better maneuverability. Of course depending on the particular application more or less swivel movement is desirable.

According to another aspect of the invention, each rear caster assembly includes a cutout and the second channel assembly includes two threaded locking screws configured to protrude into the cutout of each rear caster assembly to lock swivel movement of the rear caster assemblies. A brake pad is attached to the underside of the deck near the tail end. The brake pad aides in the user in performing maneuvers as well as braking the surfable skateboard.

A surfable skateboard is provided whereby the rear caster wheels swivel to provide more maneuverability and to mimic the surfing-like sensation experienced by a rider of a snowboard. Furthermore, pivoting front and rear wheel assemblies afford the rider to lean into turns for more balance and accentuates the surfing-like sensation of carving similar to those experienced in snowboarding. Other aspects and advantages of the present invention can be seen upon review of the figures, the detailed description, and the claims which follow.

DETAILED DESCRIPTION OF THE INVENTION

Figure 1:
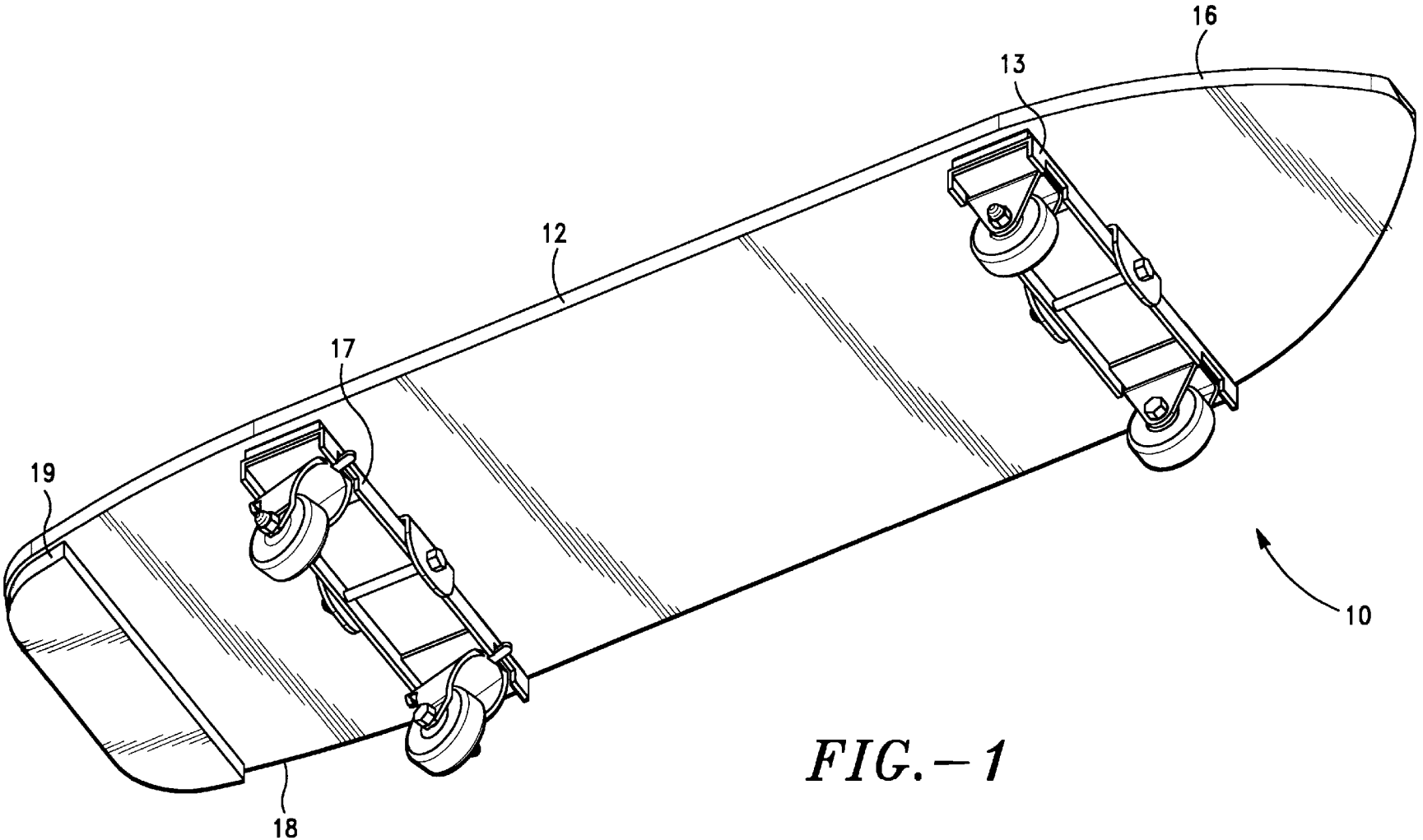
FIG. 1 illustrates an embodiment of a surfable skateboard according to the present invention.

The invention will be described with respect to the Figures in which FIG. 1 generally shows an embodiment a surfable skateboard 10 for snowboard-like maneuverability. The surfable skateboard 10 includes a deck 12 having a front channel assembly 13 mounted near a nose end 16 of the deck 12, a rear channel assembly 17 mounted near a tail end 18, and a brake pad 19 mounted near the tail end 18 of the deck 12. Preferably the surfable skateboard deck 12 is made of glass fiber reinforced plastic material with the other associated functioning parts made of various plastic or metal material following the techniques used in the art, or other suitable techniques. The variety of materials that may be used therein are well known in the art and require no separate description herein.

Figure 2:
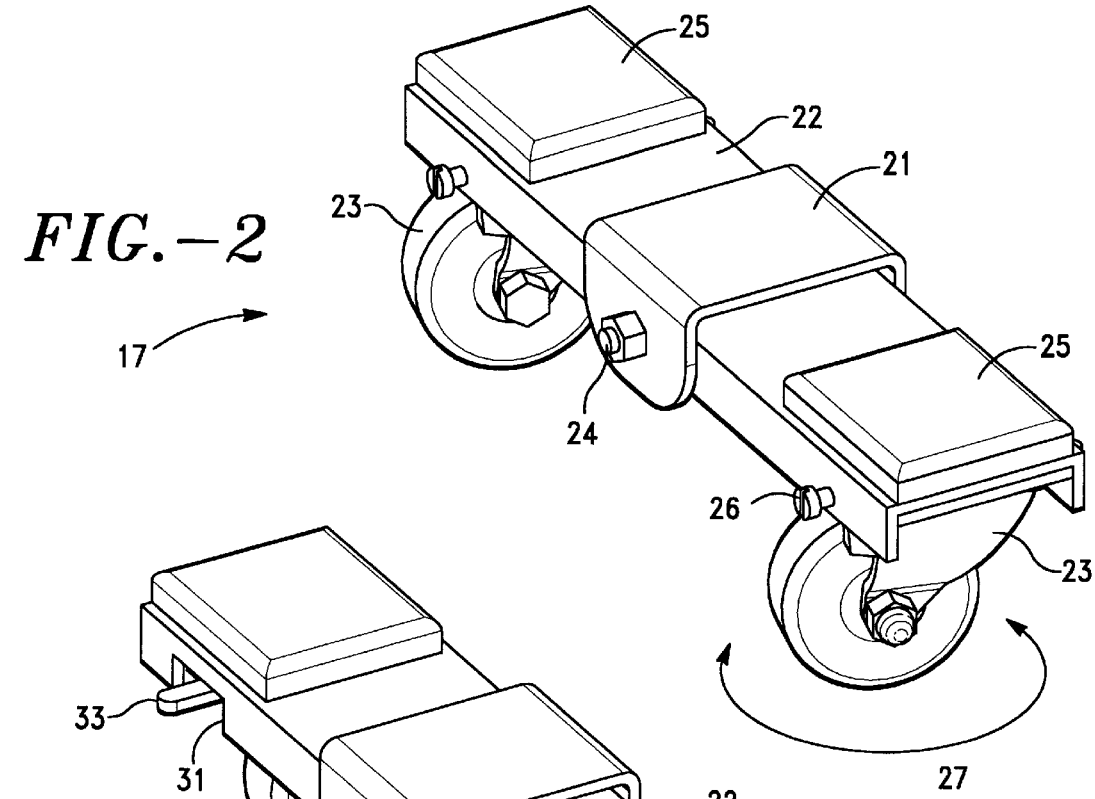
FIG. 2 illustrates a rear perspective view of a rear channel assembly according to the present invention.

FIG. 2 illustrates an aft perspective view of the rear channel assembly 17. The rear channel assembly 17 includes a U-section 21, channel section 22, caster wheel assemblies 23, bolt assembly 24, lean pads 25, and swivel lock screws 26. The U-section 21 mounts to the underside of the deck 12. Suitable mounting methods include bolting the U-section, epoxying the U-section, or molding the U-section to the underside of the deck 12. Other techniques known to those skilled in the art offer a variety of other ways to mount the U-section 21 to the deck 10. Channel section 22 pivotly mounts to the U-section 21 via bolt assembly 24 which enables the channel section 22 to pivot about the U-section 21. Caster wheel assemblies 23 pivotly mount to the underside of the channel section 22 so as to pivot in a direction depicted by arrows 27. Swivel lock screws 26 locks the caster wheel assemblies 23 to prevent the caster wheel assemblies 23 from pivoting. Lean pads 25 mount to the top side of the channel section 22. The lean pads 25 aides in limiting the lean angle of the deck 10 as a rider performs surfing-like leaning maneuvers on the surfable skateboard 10. In the present invention, the lean pads 25 are made of spongy shock absorbing material.

Referring to FIG. 1, the front channel assembly 13 is similarly assembled as the rear channel assembly 17 of FIG. 2 with the exception of the caster wheel assemblies 23. The front channel assembly 13 includes wheel assemblies that are fixed against swiveling and point in a forward direction.

Figure 3:
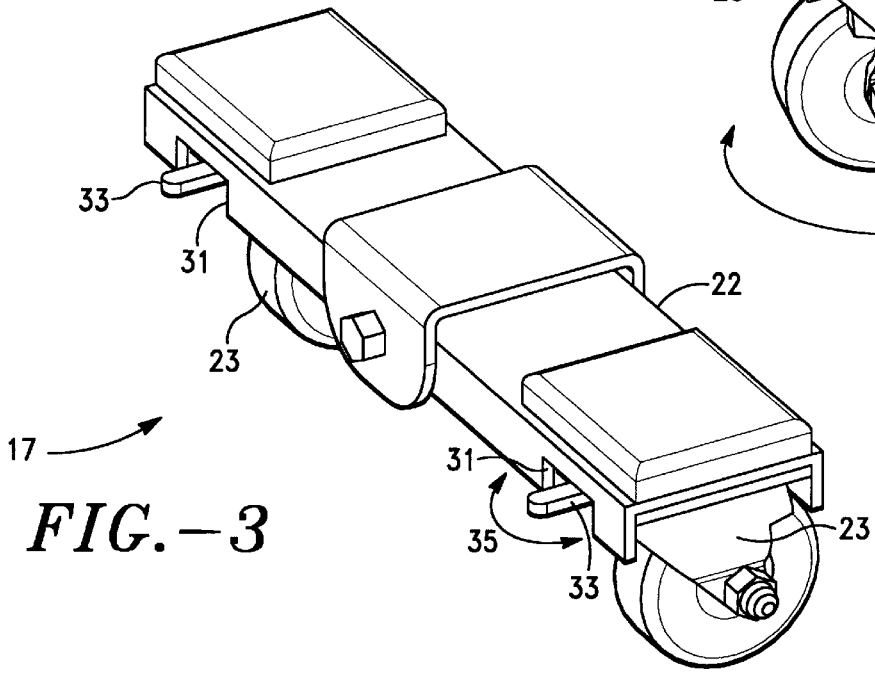
FIG. 3 illustrates a front perspective view of the rear channel assembly according to the present invention.

FIG. 3 illustrates a front perspective view of rear channel assembly 17. The channel section 22 includes cutout slots 31 and the caster wheel assemblies 23 includes a protruding limiting tang 33 that protrude from the cutout slots 31. The combination of the cutout slots 31 and the protruding limiting tang 33 limits the swivel motion of the caster wheel assemblies 23 in a direction depicted by arrows 35. In the present invention, the motion rear channel assembly 17 limits the swivel motion of the caster wheel assemblies 23 to forty-five degrees in either direction. Depending on the particular application and skill of the rider, more or less swivel motion is desirable. For example, a rider maneuvering through a tight and fast slalom course desires the swivel motion to be set for less swivel motion. On the other hand, a rider maneuvering through a slower course with wide turns desires the swivel motion to be set for more swivel motion.

In operation, a rider standing balanced along the surfable skateboard 10 shifts the weight under the rear foot so that the surfable skateboard 10 pivots about the front foot. In this way the rider directs the surfable skateboard 10 in a direction opposite the position of the rider's rear foot. By limiting the swivel motion of the caster wheel assemblies 23 of the rear channel assembly 17, the rider can exert more lean angle pressure to more perceive the sensation of surfing, particularly when the surfable skateboard 10 moves down a slight incline. The lean pads 25 affords the surfable skateboard 10 to be leaned so the rider's body leans into a turn for better balance and maneuverability. The lean pads also enable the rider to experiences the sensation of surfing while limiting the maximum lean angle so the rider will not lose control of the surfable skateboard. Varying the thickness and material of the lean pads 25 changes lean angle pressure and the perceived surfing sensation of the rider. Also, the maneuverability and stability of the surfable skateboard 10 is effected. Thus, modifying the lean pads 25 alter the ride and feel of the surfable skateboard 10. Of course care must be taken so that the user does not exceed his abilities and fall off the surfable skateboard 10.

Figure 4:
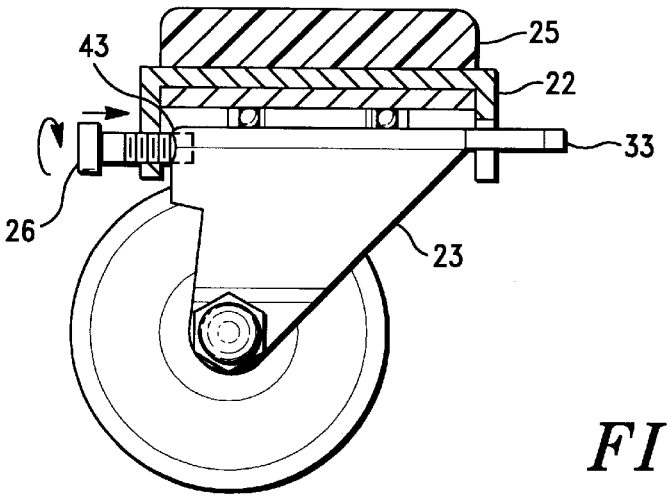
FIG. 4 illustrates a cross-section of the rear channel assembly depicted in FIG. 2 detailing a caster wheel assembly locking mechanism in accordance to the present invention.

FIG. 4 illustrates a cross-section of the rear wheel assembly 17 shown in FIG. 2 depicting a locking mechanism for locking the caster wheel assembly 23 in a forward direction. The cross-section of the rear wheel assembly 17 includes the lean pad 25, the channel section 22, the protruding limiting tang 33, the caster wheel assembly 23, the locking screw 26 and a cutout 43. The channel section 22 includes threads for the locking screw 26 to screw into the cutout 43 of the caster wheel assembly 23. The effect of the locking screw 26 screwed into the cutout 43 affords the wheel caster assembly 23 to be fixed in a forward direction.

While the foregoing detailed description has described present embodiments of the surfable skateboard, it is to be understood that the above description is illustrative only and not limiting of the disclosed invention. Obviously, many modifications and variations will be apparent to the practitioners skilled in this art. For example, modification to the front and rear wheel assemblies to include lower friction wheels or more sophisticated lean angle limiters includes modifications that are within the spirit of the disclosed invention. Accordingly, the surfable skateboard has been provided. The surfable skateboard affords users the sensation of surfing and increases maneuverability over previous skateboard designs.

What is claimed is:

1. A surfable skateboard comprising:

a deck having a tail end and a nose end;

a pair of front wheel assemblies each mounted to an underside of the deck near the nose end;

a pair of rear caster assemblies each having limited swivel configured to swivelly mount to the underside of the deck near the tail end;

a first channel assembly pivotly attached to the underside of the deck near the nose end wherein the pair of front wheels assemblies mounts to the first channel a second channel assembly pivotly attached to the underside of the deck near the tail end wherein the pair of rear caster assemblies swivel mounts to the second channel assembly;

a first U-section mounted to the underside of the deck near the nose end configured to pivotly attach the first channel assembly; and a second U-section mounted to the underside of the deck near the tail end configured to pivotly attach to the second channel assembly.

2. A surfable skateboard comprising:

a deck having a tail end and a nose end;

a pair of front wheel assemblies each mounted to an underside of the deck near the nose end;

a pair of rear caster assemblies each having limited swivel configured to swivelly mount to the underside of the deck near the tail end;

a first channel assembly pivotly attached to the underside of the deck near the nose end wherein the pair of front wheels assemblies mounts to the first channel assembly;

a second channel assembly pivotly attached to the underside of the deck near the tail end wherein the pair of rear caster assemblies swivelly mounts to the second channel assembly; and at least two lean pads attached to an upper surface of the first channel assembly and the second channel assembly configured to pivotly regulate movement of the first channel assembly and the second channel assembly.

3. A surfable skateboard comprising;

a deck having a tail end and a nose end;

a pair of front wheel assemblies each mounted to an underside of the deck near the nose end;

a pair of rear caster assemblies each having limited swivel configured to swivel mount to the underside of the deck near the tail end;

a first channel assembly pivotly attached to the underside of the deck near the nose end wherein the pair of front wheels assemblies mounts to the first channel assembly;

a second channel assembly pivotly attached to the underside of the deck near the tail end wherein the pair of rear caster assemblies swivelly mounts to the second channel assembly; and wherein:

each rear caster assembly includes a protruding limiting tang; and the second channel assembly includes cutout slots configured to receive the protruding limiting tangs for limiting swivel movement of each rear caster assembly.

4. The surfable skateboard of claim 3 wherein the limiting swivel movement includes forty-five degrees in either direction.

5. A surfable skateboard comprising:

a deck having a tail end and a nose end;

a pair of front wheel assemblies each mounted to an underside of the deck near the nose end;

a pair of rear caster assemblies each having limited swivel configured to swivelly mount to the underside of the deck near the tail end;

a first channel assembly pivotly attached to the underside of the deck near the nose end wherein the pair of front wheels assemblies mounts to the first channel assembly;

a second channel assembly pivotly attached to the underside of the deck near the tail end wherein the pair of rear caster assemblies swivelly mounts to the second channel assembly and wherein:

each rear caster assembly includes a cutout; and the second channel assembly includes two threaded locking screws configured to protrude into the cutout of each rear caster assembly to lock swivel movement of the rear caster assemblies.

6. A method of making a surfable skateboard having a deck including a nose end, a tail end, and an underside, the method comprising the steps;

pivotly attaching a first channel assembly to the underside of the deck near the nose end;

mounting a pair of front wheel assemblies to an underside of the first channel assembly;

pivotly attaching a second channel assembly to the underside of the deck near the tail end;

swivelly mounting a pair of rear caster assemblies each having limited swivel to the underside of the second channel assembly; and attaching lean pads to the first channel assembly and the second channel assembly to limit lean angle of the surfable skateboard.

* * * * *